US007444993B2

(12) United States Patent
Hofmeister

(10) Patent No.: US 7,444,993 B2
(45) Date of Patent: Nov. 4, 2008

(54) METHOD FOR MONITORING THE OPERABILITY OF A FUEL INJECTION SYSTEM

(75) Inventor: Carl-Eike Hofmeister, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/598,917

(22) PCT Filed: Jan. 20, 2006

(86) PCT No.: PCT/EP2006/050334

§ 371 (c)(1),
(2), (4) Date: Sep. 12, 2007

(87) PCT Pub. No.: WO2006/079606

PCT Pub. Date: Aug. 3, 2006

(65) Prior Publication Data

US 2008/0109144 A1 May 8, 2008

(30) Foreign Application Priority Data

Jan. 31, 2005 (DE) ..... 10 2005 004 423

(51) Int. Cl.
*F02M 51/00* (2006.01)
*F02M 51/04* (2006.01)

(52) U.S. Cl. ..... 123/479; 123/198 D

(58) Field of Classification Search ..... 123/456, 123/447, 497, 478, 479, 198 D, 446; 73/119 A, 73/117.2, 117.3
See application file for complete search history.

(56) References Cited

U.S. PATENT DOCUMENTS 5,616,837 A 4/1997 Leonard et al. ..... 73/119
5,708,202 A * 1/1998 Augustin et al. ..... 73/119 A (Continued)

FOREIGN PATENT DOCUMENTS

| | | | |
|---|---|---|---|
| DE | 19757594 | A1 | 7/1999 |
| DE | 19856203 | A1 | 6/2000 |
| DE | 199832014 | T1 | 3/2001 |
| DE | 19946506 | C1 | 7/2001 |
| DE | 10259797 | A1 | 7/2004 |
| FR | 2817915 | A1 | 12/2001 |

OTHER PUBLICATIONS

German Office Action for German Patent Application No. 10 2005 004 423.9 ( 5 pages).
International Search Report and Written Opinion for International Application No. PCT/EP2006/050334 (10 pages).

*Primary Examiner*—Mahmoud Gimie
(74) *Attorney, Agent, or Firm*—Baker Botts L.L.P.

(57) ABSTRACT

A method for monitoring the operability of injection system of an internal combustion engine is described whereby, if the quantity of fuel injected changes, a malfunction source is detected according to the behavior of the pressure obtaining in the high-pressure accumulator. An appropriate emergency control program is executed by the control unit depending on the malfunction source detected. The method describes enables a malfunction source to be simply and accurately analyzed.

19 Claims, 1 Drawing Sheet

U.S. PATENT DOCUMENTS 6,032,639 A * 3/2000 Goto et al. ..... 123/295
6,053,147 A * 4/2000 Hemmerlein et al. ..... 123/447
6,076,504 A 6/2000 Stavnheim et al. ..... 123/447
6,138,638 A * 10/2000 Morikawa ..... 123/295
6,283,108 B1 * 9/2001 Matsufuji et al. ..... 123/690
6,526,948 B1 3/2003 Stavnheim et al. ..... 123/497
6,971,368 B2 * 12/2005 Uchiyama ..... 123/359
7,137,294 B2 11/2006 Eser et al. ..... 73/119

* cited by examiner

METHOD FOR MONITORING THE OPERABILITY OF A FUEL INJECTION SYSTEM

CROSS-REFERENCE TO RELATED APPLICATIONS

This application is a U.S. national stage application of International Application No. PCT/EP2006/050334 filed Jan. 20, 2006, which designates the United States of America, and claims priority to German application number DE 10 2005 004 423.9 filed Jan. 31, 2005, the contents of which are hereby incorporated by reference in their entirety.

TECHNICAL FIELD

The invention relates to a method for monitoring the operability of a fuel injection system.

BACKGROUND

A wide variety of methods for monitoring the operability of a fuel injection system are known from the prior art. The increasingly stringent exhaust gas regulations require ever more precision from the fuel injection systems of internal combustion engines. The requirements placed on the methods for monitoring the operability of fuel injection systems are therefore also becoming more exacting.

DE 198 56 203 C2 discloses a fuel supply system for an internal combustion engine of a motor vehicle whereby fuel is delivered to a pressure accumulator by a pump. Connected to the pressure accumulator are injection valves which supply fuel to the internal combustion engine when activated by a control unit. To monitor the operability of the fuel supply system, the pressure in the pressure accumulator is caused to change by the control unit. The time required to set the pressure change is then measured. The time measured is compared with experimentally determined time values and a fault is deemed to be present if the measured time values do not correspond to the stored time values.

In addition, DE 199 46 506 C1 discloses a method for monitoring malfunctions in the pressure system of a fuel injection system by measuring the pressure change in the pressure system and determining periodic pressure variations. A fault is indicated if the periodicity of the registered pressure measuring signal deviates significantly from the pattern to be expected for fault-free operation of the system in respect of the amplitude and/or homogeneity of the pressure variations.

SUMMARY

The object to the invention is to provide an improved method for monitoring the operability of a fuel injection system.

This object can be achieved by a method for monitoring the operability of an injection system of an internal combustion engine, comprising a pressure accumulator, an injection valve connected to the pressure accumulator, a controllable fuel supply system which delivers fuel to the pressure accumulator, the method comprising the steps of: measuring the pressure in the pressure accumulator by a pressure sensor coupled with the pressure accumulator, feeding the measured pressure value to a control unit; controlling the quantity of fuel delivered by the injection valve and supplied from the fuel supply system as a function of operating parameters of the internal combustion engine, varying the quantity of fuel delivered by the injection valve, measuring a resulting pressure, comparing the resulting pressure with a setpoint pressure for the given operating conditions, and detecting a malfunction source depending on the deviation of the measured resulting pressure from the comparison value and if the measured resulting pressure is below the setpoint value.

The method has the advantage that the cause of the fault is analyzed and its source is able be determined more precisely.

In another embodiment of the invention, the leak-tightness of the injection system is detected as the malfunction source if, in the event of a change in the injection quantity, the pressure in the pressure accumulator is less than the setpoint value and a constant pressure established itself in the pressure accumulator. This means that leaks in the pressure system of the injection system can be accurately detected, thereby enabling appropriate emergency programs to be executed by the control unit.

In a further embodiment of the method according to the invention, the fuel supply is detected as the malfunction source if the injection quantity changes and the pressure in the pressure accumulator is below setpoint and the fuel pressure in the pressure accumulator changes contrary to the change in the injection quantity. Thus monitoring of the fuel supply system can be performed using the described method and if a fuel supply system malfunction is detected, an appropriate emergency program can be employed by the control unit.

In a further preferred embodiment, the pressure in the pressure accumulator is detected for a period of one second after a change in the injection quantity and the pressure measured during the measurement time is compared with a setpoint value or setpoint response. Due to the comparatively long time period, transient faults due e.g. to defective injection valves can be averaged out. This means that only faults caused by the injection system and not by the injection valves are detected.

BRIEF DESCRIPTION OF THE DRAWINGS

The invention will now be explained in greater detail with reference to the accompanying drawings in which.

DETAILED DESCRIPTION

Figure 1:
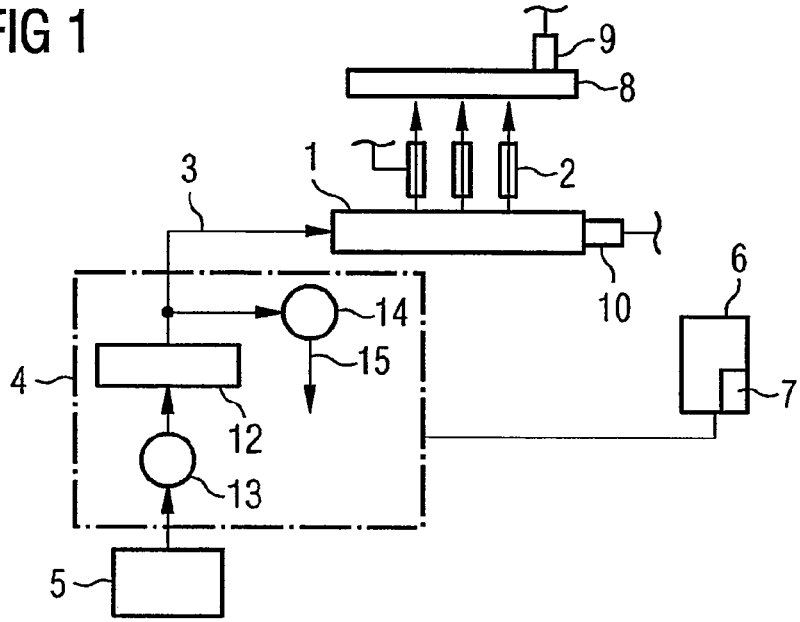
FIG. 1 schematically illustrates a fuel injection system.

FIG. 1 schematically illustrates a fuel injection system for an internal combustion engine, in particular a common rail injection system. The injection system has a high pressure accumulator 1 which is connected to the injection valves 2. The high-pressure accumulator 1 is additionally connected to a fuel supply system 4 via a supply line 3. The fuel supply system is connected to a fuel tank 5. There is additionally provided a control unit 6 which controls the fuel supply system 4 and the injection valves 2 as a function of operating conditions of an internal combustion engine. For this purpose the control unit 6 has a data memory 7 in which appropriate control programs are stored. To control the fuel supply system 4 there is provided a control line 11 between the control unit 6 and the fuel supply system 4. In addition, sensors 9 which detect the operating conditions of the internal combustion engine 8 are disposed on the internal combustion engine 8. The operating conditions thus determined, such as the engine speed and gas pedal position, are passed to the control unit 6.

Control lines for controlling the injection valves 2 are additionally implemented between the injection valves 2 and the control unit. There is additionally provided on the high-pressure accumulator 1 a pressure sensor 10 which detects the fuel pressure in the high-pressure accumulator 1 and forwards it to the control unit 6.

The task of the fuel supply system 4 is to supply the high-pressure accumulator 1 with fuel at a desired setpoint pressure under the control by the control unit 6. For this purpose the fuel supply system 4 can have various components. In the embodiment shown, the fuel supply system 4 has a fuel pump 12 and a meter-in flow control valve 13 connected between the fuel tank 5 and the fuel pump 12. Between the fuel pump 12 and the high-pressure accumulator 1 there is additionally connected a pressure valve 14 whose output is connected to a return line 15.

For controlling the amount of fuel supplied to the high-pressure accumulator 1, a flow cross section of the meter-in flow control valve 13 is increased to a lesser or greater degree by the control unit 6 so that a larger or smaller amount of fuel can be delivered to the high-pressure accumulator 1 by the fuel pump 12. Additionally available as a further means of influencing the fuel pressure in the high-pressure accumulator 1 is the pressure valve 14 which is likewise actuated by the control unit 6. If the pressure valve 14 is caused to open by the control unit 6, fuel which has already been compressed by the fuel pump 12 and pumped into the supply line 3 is fed back into the fuel tank 5 via the return line 15, thereby reducing the fuel pressure in the high-pressure accumulator 1.

During operation of the internal combustion engine, the fuel supply to the high-pressure accumulator 1, the fuel pressure in the high-pressure accumulator 1 and the quantity of fuel delivered by the injection valves 2 is adjusted according to defined control programs as a function of operating conditions of the internal combustion engine 8.

The pressure at which the fuel is injected is an essential criterion for the exhaust quality of the internal combustion engine and must therefore be precisely adhered to.

Figure 2:
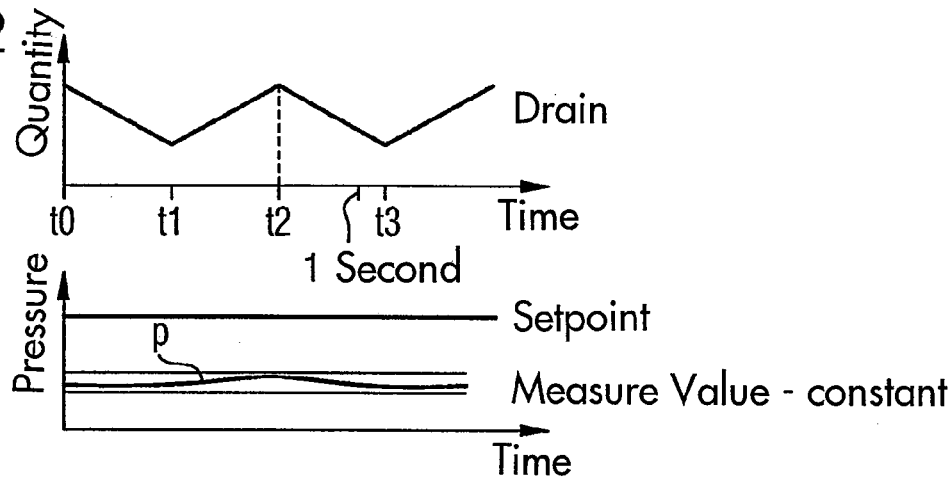
FIG. 2 shows two diagrams the detecting a first fault scenario.

FIG. 2 (top) shows the time response of the quantity of fuel delivered by the injection valves 2. The lower diagram plots the parallel time response of the pressure in the high-pressure accumulator 1 which is detected by the pressure sensor 10. The top diagram shows that the quantity of fuel at instant t0 falls from an upper value to a lower value at instant t1 and then increases again to a higher value at instant t2, falling again to a lower value at instant t3. The time between the $0^{th}$ instant t0 and the third instant t3 is longer than 1 second.

In parallel with this, the lower diagram plots both the setpoint value of the fuel pressure and the measured pressure p over time. The setpoint is specified by the control program depending on operating conditions of the internal combustion engine. The control unit 6 activates the fuel supply system 4 such that the setpoint pressure is set. The lower diagram shows that during the measuring period, i.e. from the $0^{th}$ instant t0 to the third instant t3, the pressure value p measured remains virtually constant and is below the setpoint pressure.

The control unit 6 therefore detects that a malfunction is present in the fuel supply system 4. The control unit 6 can also detect on the basis of the existing situation, i.e. the injected fuel quantity changes over time and the fuel pressure obtaining in the high-pressure accumulator 1 remains virtually constant and below setpoint, that a pressure valve malfunction is present. For the detection of a virtually constant pressure, a pressure range of e.g. 3% is specified within which the fuel pressure in the high-pressure accumulator 1 may vary during measurement, the control unit 6 nevertheless detecting a constant fuel pressure in the high-pressure accumulator 1, however.

If the control 6 detects a fault in the pressure valve 14, an appropriately prepared emergency program is used by the control unit 6 for the subsequent activation of the fuel supply system 4 and/or injection valves 2. The emergency program is stored in the memory 7 of the control unit 6.

Figure 3:
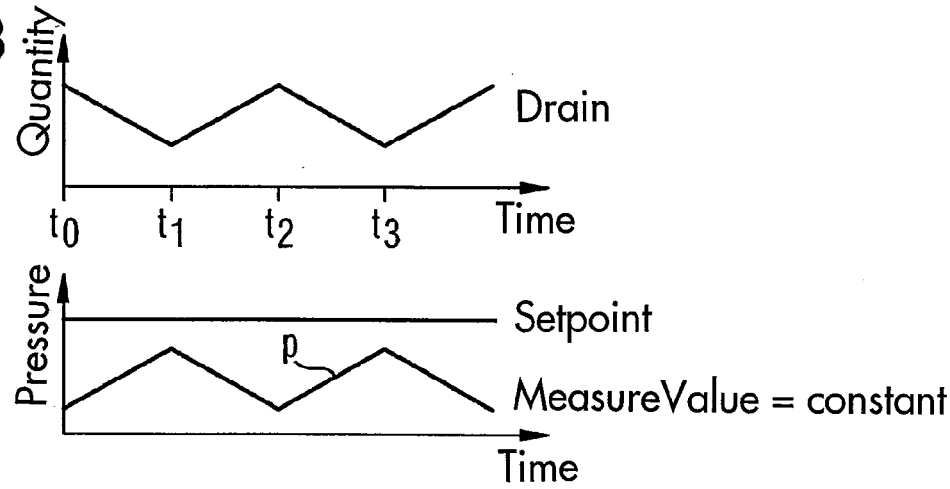
FIG. 3 shows two diagrams the detecting a second fault scenario.

FIG. 3 shows another fault scenario. FIG. 3 again shows the variation in the amount of fuel injected by the injection valves 2 over time. In the lower diagram, the setpoint value of the fuel pressure and the measured fuel pressure are simultaneously plotted over time. Also in this situation the quantity of fuel injected by the injection valves 2 is reduced from a high value at instant t0 to a lower value at the first instant t1, then increased to a higher value at the second instant t2 whereupon it is reduced to a lower value at the third instant t3. The time between the $0^{th}$ instant t0 and the third instant t3 corresponds to approximately 1 second.

The time response of the measured pressure in the high-pressure accumulator 1 exhibits a pressure variation contrary to the fuel variation, i.e. while the amount of fuel injected is falling, the fuel pressure in the high-pressure accumulator 1 is increasing and vice versa. The control unit 6 therefore unambiguously detects a malfunction of the meter-in flow control valve 13. If a malfunction of the meter-in flow control valve 13 is detected, an appropriate emergency program for the subsequent activation of the supply system 4 and/or the injection valves 2 is employed by the control unit 6.

For example, the emergency program used in the event of a meter-in flow control valve malfunction reduces the quantity of fuel to be injected by the injection valves 2. If a defective pressure valve is detected, the pressure setpoint value is additionally limited, for example.

Other parameters for the emergency program to be used can be limited or varied depending on the application.

What is claimed is:

1. A method for monitoring the operability of an injection system of an internal combustion engine, comprising a pressure accumulator, an injection valve connected to the pressure accumulator, a controllable fuel supply system which delivers fuel to the pressure accumulator, the method comprising the steps of:

measuring the pressure in the pressure accumulator by a pressure sensor coupled with the pressure accumulator, feeding the measured pressure value to a control unit;

controlling the quantity of fuel delivered by the injection valve and supplied from the fuel supply system as a function of operating parameters of the internal combustion engine, varying the quantity of fuel delivered by the injection valve, measuring a resulting pressure, comparing the resulting pressure with a setpoint pressure for the given operating conditions, and detecting a malfunction source depending on the deviation of the measured resulting pressure from the comparison value and if the measured resulting pressure is below the setpoint value, wherein in case of a change of injection quantity, a pressure valve connected to the pressure accumulator which cannot set the desired pressure is detected as the source of a fault, if the pressure is below setpoint in the pressure accumulator, and in case of an approximately constant pressure in the pressure accumulator.

2. The method according to claim 1, wherein, the pressure is measured over a measuring period of 1 second and the time response of the pressure during the measuring period is compared with a setpoint response.

3. The method according to claim 1, wherein, depending on the fault detected, an appropriate emergency program for control by the control unit is used, wherein appropriate emergency programs being available to the control unit for the various malfunctions.

4. A method for monitoring the operability of an injection system of an internal combustion engine, comprising a pressure accumulator, an injection valve connected to the pressure accumulator, a controllable fuel supply system which delivers fuel to the pressure accumulator, the method comprising the steps of:

measuring the pressure in the pressure accumulator by a pressure sensor coupled with the pressure accumulator, feeding the measured pressure value to a control unit;

controlling the quantity of fuel delivered by the injection valve and supplied from the fuel supply system as a function of operating parameters of the internal combustion engine, varying the quantity of fuel delivered by the injection valve, measuring a resulting pressure, comparing the resulting pressure with a setpoint pressure for the given operating conditions, and detecting a malfunction source depending on the deviation of the measured resulting pressure from the comparison value and if the measured resulting pressure is below the setpoint value, wherein in case of a change of the injection quantity, if the pressure is below setpoint in the pressure accumulator, and if the pressure in the pressure accumulator changes contrary to the change in the injection quantity, the fuel supply system which does not supply sufficient fuel is detected as the source of the fault.

5. The method according to claim 4, wherein, the pressure is measured over a measuring period of 1 second and the time response of the pressure during the measuring period is compared with a setpoint response.

6. The method according to claim 4, wherein, depending on the fault detected, an appropriate emergency program for control by the control unit is used, wherein appropriate emergency programs being available to the control unit for the various malfunctions.

7. A method for monitoring the operability of an injection system of an internal combustion engine, comprising the steps of:

measuring the pressure in a pressure accumulator by a pressure sensor, controlling the quantity of fuel delivered by an injection valve and supplied from a fuel supply system as a function of operating parameters of the internal combustion engine, varying the quantity of fuel delivered by the injection valve, measuring a resulting pressure, comparing the resulting pressure with a setpoint pressure for the given operating conditions, and detecting a malfunction source depending on the resulting pressure and on the deviation of the resulting pressure from the comparison value, wherein, in case the injection quantity changes, if the pressure is below setpoint in the pressure accumulator, and in case of an approximately constant pressure in the pressure accumulator, a pressure valve connected to the pressure accumulator is detected as the source of the fault.

8. The method according to claim 7, wherein, the pressure is measured over a measuring period of 1 second and the time response of the pressure during the measuring period is compared with a setpoint response.

9. The method according to claim 7, wherein, depending on the fault detected, an appropriate emergency program for control by the control unit is used, wherein appropriate emergency programs being available to the control unit for the various malfunctions.

10. A method for monitoring the operability of an injection system of an internal combustion engine, comprising the steps of:

measuring the pressure in a pressure accumulator by a pressure sensor, controlling the quantity of fuel delivered by an injection valve and supplied from a fuel supply system as a function of operating parameters of the internal combustion engine, varying the quantity of fuel delivered by the injection valve, measuring a resulting pressure, comparing the resulting pressure with a setpoint pressure for the given operating conditions, and detecting a malfunction source depending on the resulting pressure and on the deviation of the resulting pressure from the comparison value, wherein, in case the injection quantity changes and the pressure is below setpoint in the pressure accumulator, and if the pressure in the pressure accumulator changes contrary to the change in the injection quantity, the fuel supply system is detected as the source of the fault.

11. The method according to claim 10, wherein, the pressure is measured over a measuring period of 1 second and the time response of the pressure during the measuring period is compared with a setpoint response.

12. The method according to claim 10, wherein, depending on the fault detected, an appropriate emergency program for control by the control unit is used, wherein appropriate emergency programs being available to the control unit for the various malfunctions.

13. A system for monitoring the operability of an injection system of an internal combustion engine, comprising:

a pressure accumulator, an injection valve connected to the pressure accumulator, a controllable fuel supply system which delivers fuel to the pressure accumulator, a pressure sensor coupled with the pressure accumulator, a control unit controlling the quantity of fuel delivered by an injection valve and supplied from a fuel supply system as a function of operating parameters of the internal combustion engine, and varying the quantity of fuel delivered by the injection valve, a comparator comparing the resulting pressure with a setpoint pressure for the given operating conditions, and detecting a malfunction source depending on the resulting pressure and on the deviation of the resulting pressure from the comparison value, wherein, in case the injection quantity changes and the pressure is below setpoint in the pressure accumulator, and in case of an approximately constant pressure in the pressure accumulator, a pressure valve connected to the pressure accumulator is detected as the source of the fault.

14. The system according to claim 13, wherein, the pressure is measured over a measuring period of 1 second and the time response of the pressure during the measuring period is compared with a setpoint response.

15. The method according to claim 13, wherein, depending on the fault detected, an appropriate emergency program for control by the control unit is used, wherein appropriate emergency programs being available to the control unit for the various malfunctions.

16. A system for monitoring the operability of an injection system of an internal combustion engine, comprising:

a pressure accumulator, an injection valve connected to the pressure accumulator, a controllable fuel supply system which delivers fuel to the pressure accumulator, a pressure sensor coupled with the pressure accumulator, a control unit controlling the quantity of fuel delivered by an injection valve and supplied from a fuel supply system as a function of operating parameters of the internal combustion engine, and varying the quantity of fuel delivered by the injection valve, a comparator comparing the resulting pressure with a setpoint pressure for the given operating conditions, and detecting a malfunction source depending on the resulting pressure and on the deviation of the resulting pressure from the comparison value, wherein, if the injection quantity changes, if the pressure is below setpoint in the pressure accumulator, and if the pressure in the pressure accumulator changes contrary to the change in the injection quantity, the fuel supply system is detected as the source of the fault.

17. The system according to claim 16, wherein, the pressure is measured over a measuring period of 1 second and the time response of the pressure during the measuring period is compared with a setpoint response.

18. The method according to claim 16, wherein, depending on the fault detected, an appropriate emergency program for control by the control unit is used, wherein appropriate emergency programs being available to the control unit for the various malfunctions.

19. A method for monitoring the operability of an injection system of an internal combustion engine, comprising a pressure accumulator, an injection valve connected to the pressure accumulator, a controllable fuel supply system which delivers fuel to the pressure accumulator, the method comprising the steps of:

measuring the pressure in the pressure accumulator by a pressure sensor coupled with the pressure accumulator, feeding the measured pressure value to a control unit;

controlling the quantity of fuel delivered by the injection valve and supplied from the fuel supply system as a function of operating parameters of the internal combustion engine, varying the quantity of fuel delivered by the injection valve, measuring a temporal resulting pressure over a measuring period of 1 second;

comparing the temporal response of the pressure during the measuring period with a temporal setpoint pressure for the given operating conditions, and detecting a malfunction source depending on the deviation of the measured resulting pressure from the comparison value and if the measured resulting pressure is below the setpoint value.

* * * * *